US009194553B2

(12) United States Patent
Sheu

(10) Patent No.: US 9,194,553 B2
(45) Date of Patent: Nov. 24, 2015

(54) VEHICLE LAMP WITH LASER LIGHTING SOURCE

(71) Applicant: HON HAI PRECISION INDUSTRY CO., LTD., New Taipei (TW)

(72) Inventor: Yi-Zhong Sheu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 258 days.

(21) Appl. No.: 13/755,085

(22) Filed: Jan. 31, 2013

(65) Prior Publication Data

US 2014/0169018 A1 Jun. 19, 2014

(30) Foreign Application Priority Data

Dec. 13, 2012 (TW) ..... 101147098 A

(51) Int. Cl.
*F21S 8/10* (2006.01)
*F21S 10/00* (2006.01)

(52) U.S. Cl.
CPC ..... *F21S 48/1145* (2013.01); *F21S 48/1104* (2013.01); *F21S 10/00* (2013.01)

(58) Field of Classification Search
CPC ..... B60Q 1/04; B60Q 1/0023; B60Q 1/08; B60Q 1/18; B60Q 2300/056; B60Q 2400/50; B60Q 2300/45; B60Q 1/085; B60Q 2300/42; B60Q 1/06; B60Q 1/1423; B60Q 1/1415; B60Q 1/16; F21S 48/1127; F21S 48/1145; F21S 48/1159; F21S 48/1757; F21S 48/1742; F21S 48/1154; F21S 10/00; F21S 48/1104; F21S 48/115; F21Y 2101/025; F21Y 2101/02; F21Y 2105/00; H01S 5/00; F21V 11/18; F21W 2101/10; A61F 9/008; G11B 19/28
USPC ..... 342/70; 340/425.5, 557; 362/259, 514, 362/516, 602
See application file for complete search history.

(56) References Cited

U.S. PATENT DOCUMENTS

| | | | | |
|---|---|---|---|---|
| 5,365,413 | A * | 11/1994 | Krammer | 362/464 |
| 2005/0201116 | A1* | 9/2005 | Browne et al. | 362/509 |
| 2006/0158887 | A1* | 7/2006 | Holder et al. | 362/341 |
| 2012/0069593 | A1* | 3/2012 | Kishimoto et al. | 362/511 |
| 2013/0154815 | A1* | 6/2013 | Min et al. | 340/425.5 |

* cited by examiner

*Primary Examiner* — Mary McManmon
*Assistant Examiner* — Danielle Allen
(74) *Attorney, Agent, or Firm* — Novak Druce Connolly Bove + Quigg LLP

(57) ABSTRACT

An exemplary vehicle lamp includes a laser lighting source for emitting a laser beam, a rotor, and a reflector having a reflecting surface. The laser lighting source is mounted on the rotor. The laser beam function as a spot light and illuminates each time a part of the reflecting surface. The laser lighting source rotates rapidly with the rotor to change the illuminated part of the reflecting surface. Human eyes have visual lag. The laser lighting source rotates fast enough to have the laser beam illuminates sequentially every parts of the reflecting surface rapidly. The laser beam is reflected to form a surface illumination recognized by the human eyes to illuminate a front of the vehicle.

9 Claims, 4 Drawing Sheets

VEHICLE LAMP WITH LASER LIGHTING SOURCE

BACKGROUND

1.Technical Field

The present disclosure relates to lamps, and more particularly to a vehicle lamp having a laser lighting source.

2.Description of Related Art

A conventional vehicle lamp is a high intensity discharge lamp or an LED lamp. The conventional vehicle lamp generally generates a smooth round light field with a radiation angle of 100 degrees (±50 degrees). The light emitted from the LED is mainly concentrated at a center thereof. The light at a periphery of the light field of the conventional vehicle lamp is relatively poor and can not be used to illuminate effectively. Simultaneously, light intensity of the conventional vehicle lamp is low. Thus, when the conventional vehicle lamps are used, drivers are at great risk.

Accordingly, it is desirable to provide a vehicle lamp which can overcome the described limitations.

DETAILED DESCRIPTION

Embodiments of vehicle lamp will now be described in detail below and with reference to the drawings.

Figure 1:
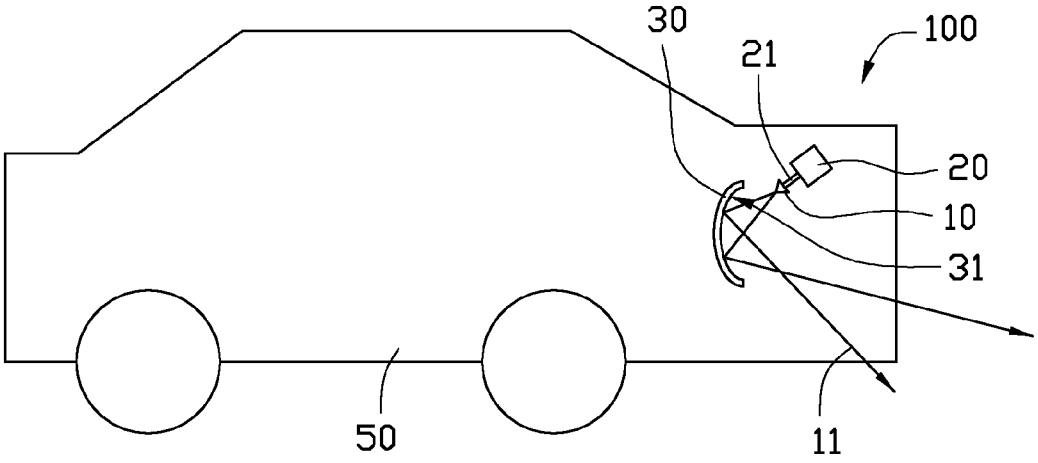
FIG. 1 is a schematic view of a vehicle lamp of a first embodiment of a present disclosure.

Referring to FIG. 1, a vehicle lamp 100 according to a first embodiment of the present disclosure is shown. The vehicle lamp 100 includes a laser lighting source 10, a motor 20, and a reflector 30.

The laser lighting source 10 is a laser diode for emitting a laser beam 11 function as a spot light. A central portion and a periphery of the laser beam 11 have a uniform and high illumination intensity. The motor 20 includes a rotor 21. The laser lighting source 10 is mounted on a free end of the rotor 21.

The reflector 30 is arc-shaped to reflect the laser beam 11 to an outside of a vehicle 50 to illuminate. In this embodiment, the reflector 30 is mounted on the vehicle 50 and has a concave reflecting surface 31 oriented towards a front side of the vehicle 50. The laser lighting source 10 is located at a front side of the reflecting surface 31 and spaced from and located near a top of the reflector 30.

In use, the laser lighting source 10 is powered and emits the laser beam 11. The laser beam 11 is oriented towards the reflecting surface 31 and illuminates each time a part of the reflecting surface 31. The laser lighting source 10 rotates rapidly with the rotor 21 controlled by the motor 20 to change the illuminated part of the reflecting surface 31. Human eyes have visual lag. When the spot light moves fast enough through a line of the reflecting surface 31, a line of light will be recognized by the human eyes. Similarly, when the laser lighting source 10 is controlled by the motor 20 to rotate fast enough, the laser beam 11 illuminates sequentially every part of the reflecting surface 31 to illuminate all of the reflecting surface 31 rapidly and is reflected to form an illumination in front of the vehicle 50 which is recognized by the human eyes as a surface illumination.

The reflector 30 is rotatable relative to the vehicle 50 to adjust an illumination direction of the vehicle lamp 100.

Figure 2:
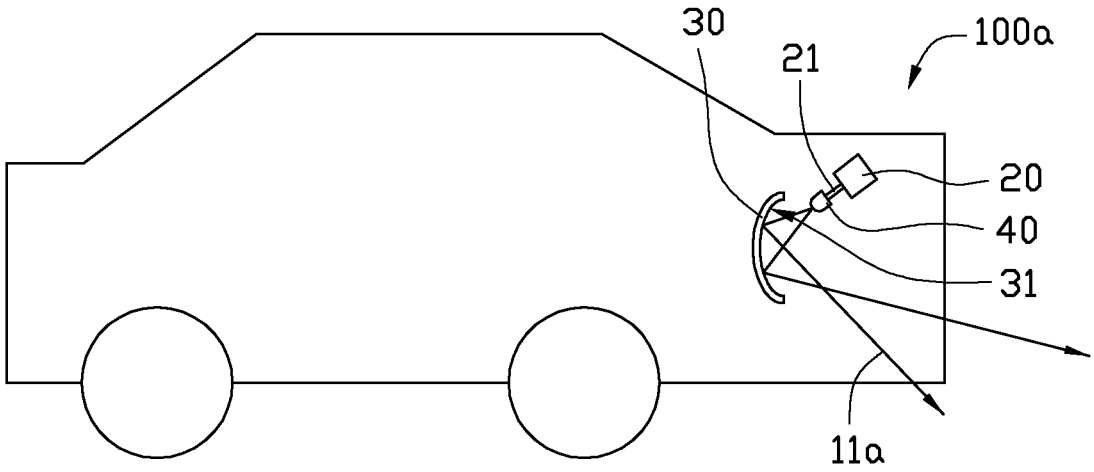
FIG. 2 is a schematic view of a vehicle lamp of a second embodiment of a present disclosure.
Figure 3:
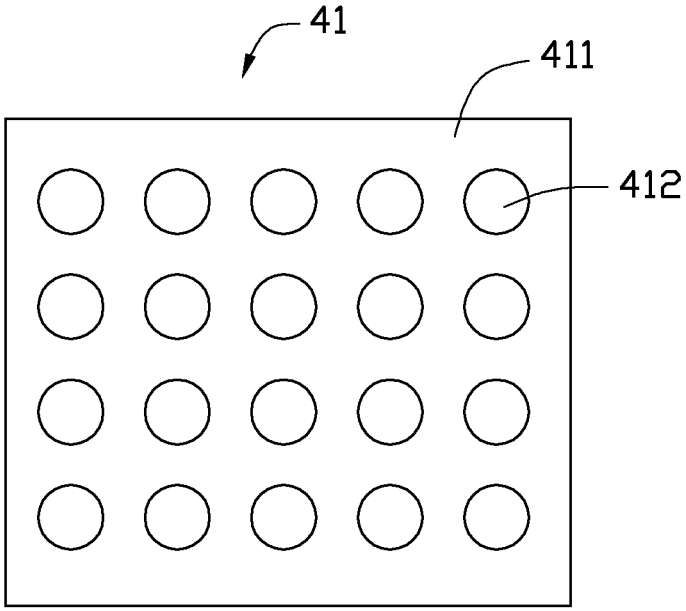
FIG. 3 is a schematic view of a light source of the vehicle lamp of FIG. 2.
Figure 4:
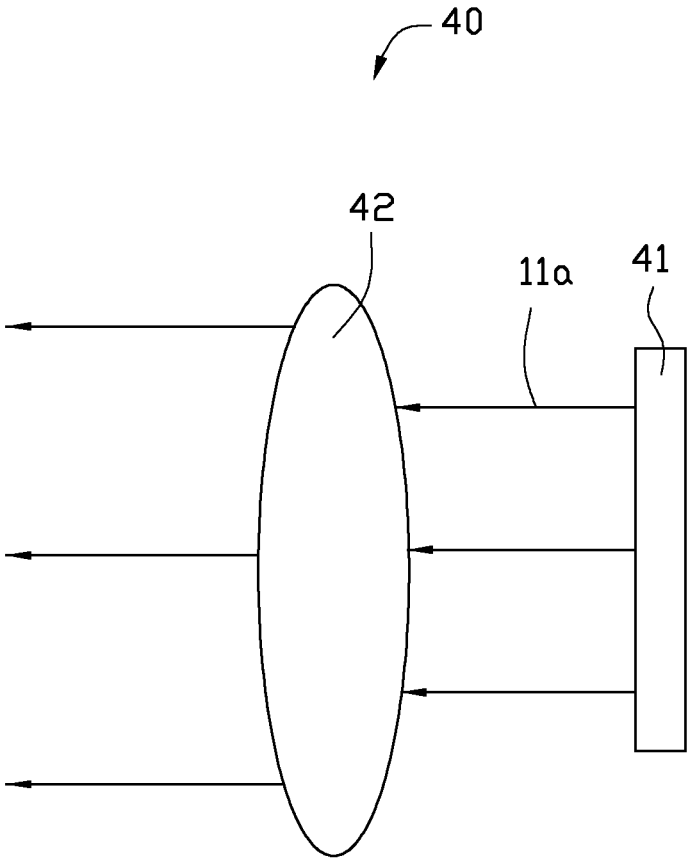
FIG. 4 is a schematic view of the light source and a lens of the vehicle lamp of FIG. 2.

Referring to FIGS. 2-4, a vehicle lamp 100*a* according to a second embodiment of the present disclosure is shown. The vehicle lamp 100*a* and the vehicle lamp 100 are similar and a difference therebetween is that the vehicle lamp 100*a* has a laser lighting source 40 which is different from the laser lighting source 10 of the vehicle lamp 100. The laser lighting source 40 includes a laser lighting matrix 41 and a lens 42 engaging with the lighting matrix 41. The laser lighting matrix 41 includes a base 411 and a plurality of laser diodes 412 arranged on the base 411. The laser diodes 412 are arranged in a rectangular matrix which defines a plurality of lines along a horizontal direction and a vertical direction of the base 411. The lens 42 is arranged on an optical path of the lighting matrix 41 to diffuse the laser beams 11*a* emitted from the laser diodes 412 to make the laser beams 11*a* illuminate an entirety of the reflecting surface 31 faster than the first embodiment.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A vehicle lamp for a vehicle comprising:

a laser lighting source for emitting a laser beam;

a motor with a rotor, and the laser lighting source mounted on the rotor whereby when the rotor rotates, the laser lighting sources rotates accordingly; and a reflector having a reflecting surface oriented towards the laser lighting source;

wherein the laser lighting source is located at a front side of the reflector and spaced from the reflector, the reflector is rotatable relative to the vehicle, the laser beam each time illuminates a part of the reflecting surface, the laser lighting source rotates with the rotor controlled by the motor to change the illuminated part of the reflecting surface, the laser beam illuminates sequentially every part of the reflecting surface to illuminate an entirety of the reflecting surface and is reflected by reflecting surface to form a surface illumination configured to illuminate a front of the vehicle.

2. The vehicle lamp of claim 1, wherein the reflecting surface is concave.

3. The vehicle lamp of claim 1, wherein the laser lighting source is located at a front side of the reflecting surface.

4. The vehicle lamp of claim 1, wherein the reflector is mounted on the vehicle.

5. The vehicle lamp of claim 1, wherein the laser light source is a laser diode.

6. The vehicle lamp of claim 1, wherein the laser lighting source comprises a laser lighting matrix and a lens engaging with the laser lighting matrix.

7. The vehicle lamp of claim 6, wherein the laser lighting matrix comprises a base and a plurality of laser diodes arranged on the base.

8. The vehicle lamp of claim 7, wherein the laser diodes are arranged on a rectangular matrix which defines a plurality of lines along a vertical direction and a horizontal direction of the base.

9. The vehicle lamp of claim 7, wherein the lens is arranged on an optical path of the lighting matrix to diffuse the laser beams emitted from the laser diodes.

* * * * *